US006588466B1

(12) United States Patent
Lohr

(10) Patent No.: US 6,588,466 B1
(45) Date of Patent: Jul. 8, 2003

(54) LIQUID MIXING AND DISPENSING APPARATUS

(75) Inventor: James H. Lohr, Union Grove, WI (US)

(73) Assignee: JohnsonDiversey, Inc., Sturtevant, WI (US)

( * ) Notice: Subject to any disclaimer, the term of this patent is extended or adjusted under 35 U.S.C. 154(b) by 0 days.

(21) Appl. No.: 10/055,185

(22) Filed: Jan. 23, 2002

(51) Int. Cl.[7] ..... B65B 1/04

(52) U.S. Cl. ..... 141/362; 141/9; 141/105; 141/351; 141/DIG. 1

(58) Field of Search ..... 141/9, 100, 105–107, 141/351–354, 360–362, DIG. 1

(56) References Cited

U.S. PATENT DOCUMENTS

| | | | | |
|---|---|---|---|---|
| 4,121,741 A | | 10/1978 | Adamson | 222/181 |
| 4,382,449 A | | 5/1983 | Nelson | 137/38 |
| 4,934,651 A | | 6/1990 | Nowicki | 251/54 |
| 5,450,877 A | | 9/1995 | Graffin | 137/630 |
| 5,832,972 A | | 11/1998 | Thomas et al. | 141/360 |
| 5,896,898 A | * | 4/1999 | Crossdale et al. | 141/83 |

OTHER PUBLICATIONS

One page of a S. C. Johnson maintenance guide sheet entitled "Valve Rebuild Kit" dated 1997 showing a button activated magnetic valve.

A photograph of a Dema dispensing valve, admitted prior art..

A photograph of a Hydro dispensing valve, admitted prior art.

* cited by examiner

*Primary Examiner*—J. Casimer Jacyna

(74) *Attorney, Agent, or Firm*—Neil E. Hamilton; Warren R. Bovee; Renee J. Rymarz

(57) ABSTRACT

A magnetically operable mixing and dispensing apparatus which is operable with one hand. A bottle contact portion is provided on a magnetic activating member which activates a moveable element of the valve. The apparatus eliminates frictional contact with the valve thus resulting in longer life. The apparatus is easily retrofitted.

9 Claims, 7 Drawing Sheets

LIQUID MIXING AND DISPENSING APPARATUS

BACKGROUND OF THE INVENTION

1. Technical Field

This invention relates generally to liquid mixing and dispensing. More particularly it relates to a liquid mixing and dispensing apparatus wherein a liquid solution can be prepared and dispensed into a bottle with a one hand procedure.

2. Background Art

Mixing and dispensing apparatus of the type which mix a chemical cleaning or sanitizing concentrate with water are well known. The resulting solutions can be filled into suitable containers such as bottles or buckets. They can also be sprayed. Apparatus of this type are available from Johnson Wax Professional of Sturtevant, Wis. as the J-FILL™ dispensing units, Solution Centers™ or Clean-Pak™ units.

While the previously referred to units afford ease of dispensing, they do require a two hand procedure for operation. One hand is required to hold a bottle into which the solution is dispensed while the other is employed to activate a valve. A more convenient operation would be afforded if only a single hand were required for the dispensing.

In U.S. Pat. No. 5,832,972, a dispensing system of the type concerned with in this invention is described with a one hand procedure. However, the apparatus described in this patent requires a frictional engagement with a valve button which results in wear and tear on the engaging parts. Also, the design of the slide actuator which contacts the valve requires extensive travel and movement of the bottle.

A magnetically actuated valve for use with an eductor in a dispensing apparatus is available from Hydro Systems of Cincinnati, Ohio. It employs a slideable bracket and magnet which are connected by a chain with the magnet actuating a magnetically operable valve.

A magnetically operated valve with a timer assembly for use in dispensing a chemical solution is disclosed in U.S. Pat. No. 4,934,651. A magnetically operated push button valve for use in conjunction with a chemical solution apparatus is available from Dema Engineering Company in St. Louis, Mo.

There are available magnetically operable valves which obviate frictional engagement with a valve in order to operate it. These are described in U.S. Pat. Nos. 5,450,877; 4,121,741 and 4,382,449. However, the magnetically operable valves described in these patents do not lend themselves for use with a liquid mixing and dispensing apparatus.

Accordingly, there is a need for an improved liquid mixing and dispensing apparatus which is operable with one hand.

The objects of the invention therefore are:

a. Providing an improved liquid mixing and dispensing apparatus.

b. Providing a liquid mixing and dispensing apparatus which is easy to operate.

c. Providing a liquid mixing and dispensing apparatus wherein a bottle can be filled therefrom with a one hand procedure.

d. Providing a liquid mixing and dispensing apparatus of the foregoing type which obviates frictional engagement between a valve and a valve activating mechanism.

e. Providing a liquid mixing and dispensing apparatus of the foregoing type which is easily retrofitted.

SUMMARY OF THE INVENTION

The foregoing objects are accomplished and the shortcomings of the prior art are overcome by the liquid mixing and dispensing apparatus of this invention which includes an eductor member having a liquid inlet, an inlet for liquid concentrate and an outlet for a mixed solution. A valve member is operatively connected to the liquid inlet of the eductor, the valve member including a magnetically operable moveable element for controlling the flow of liquid to the liquid inlet of the eductor. A magnetic activating member is operatively associated with the moveable element. A magnet support member is connected to the magnetic activating member and a magnet is connected to the magnet support member. The magnetic activating member moves in a direction of the moveable element to open and close the valve member and includes a bottle contact portion positioned proximate the eductor outlet.

In a preferred embodiment, the magnetic activating member comprises a slideable member operatively connected to the valve member.

In one aspect, the magnet is of a horse shoe configuration.

In another aspect, the magnet is of an annular configuration and surrounds a valve stem of the valve member.

In yet another aspect, a method is provided for utilizing the apparatus of this invention.

These and still other objects and advantages of the invention will be apparent from the description which follows. In the detailed description below preferred embodiments of the invention will be described in reference to the full scope of the invention. The invention may be employed in still other embodiments.

DESCRIPTION OF THE PREFERRED EMBODIMENT

Figure 1:
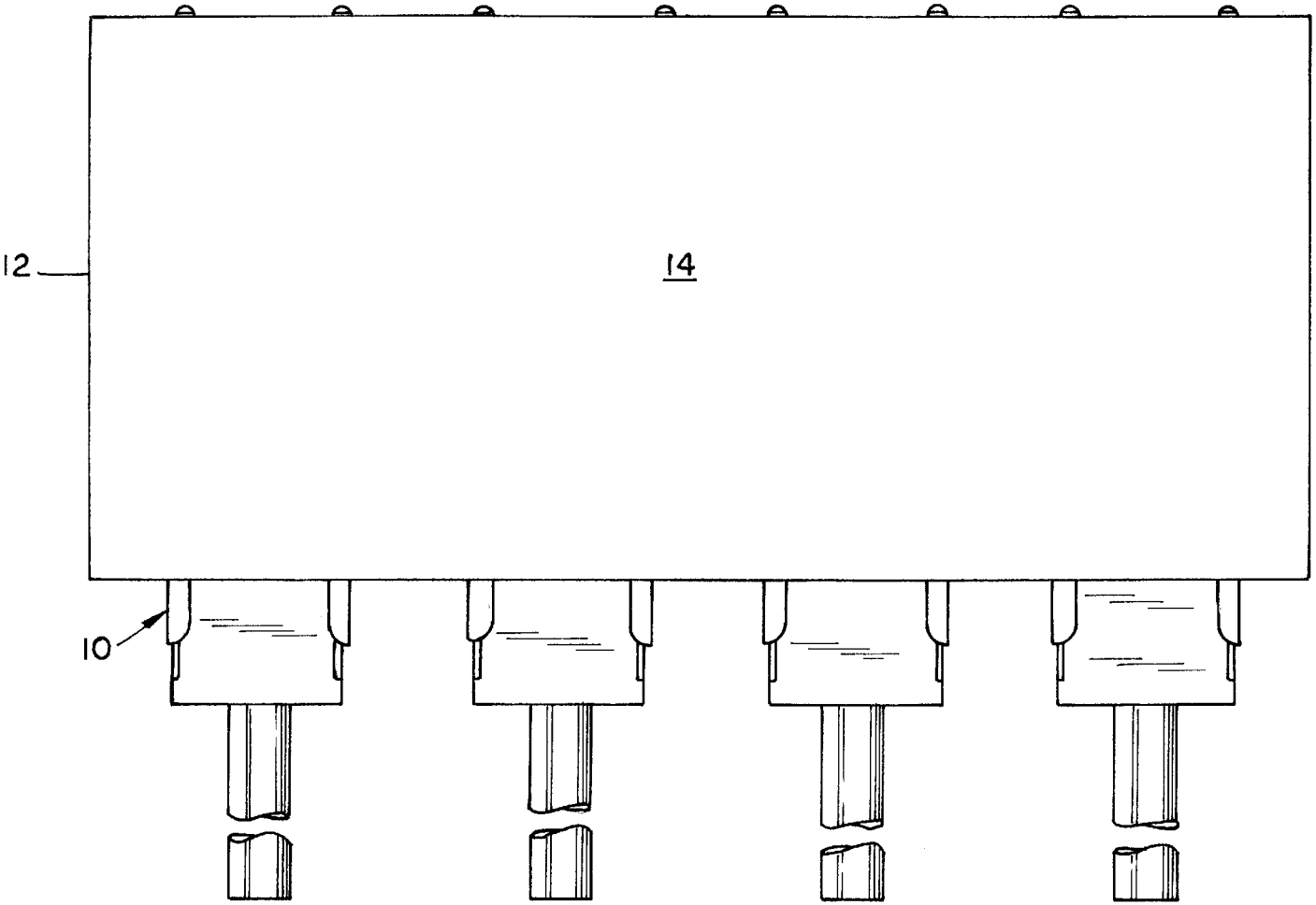
FIG. 1 is a front view of the liquid mixing and dispensing apparatus of this invention.
Figure 2:
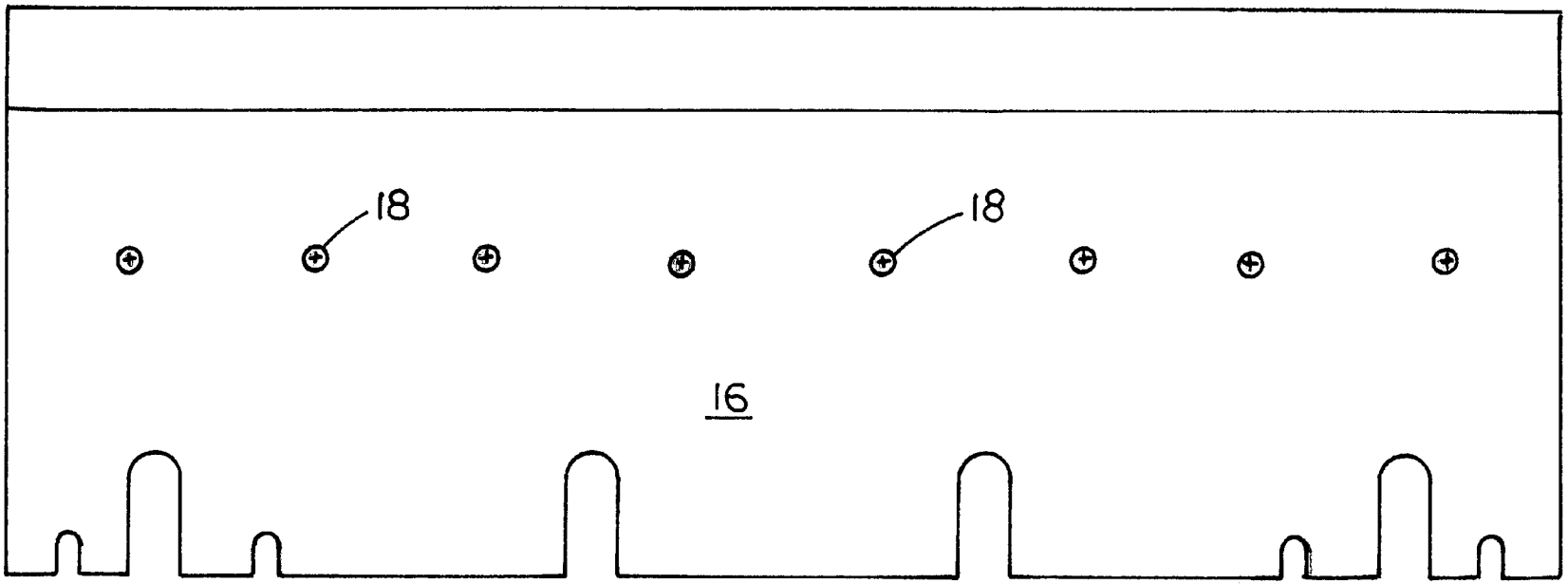
FIG. 2 is a top view of the apparatus shown in FIG. 1.

Referring to FIGS. 1 and 2, the dispensing apparatus generally 10 is shown in a housing 12 composed of a front panel 14 and a top panel 16.

Figure 4:
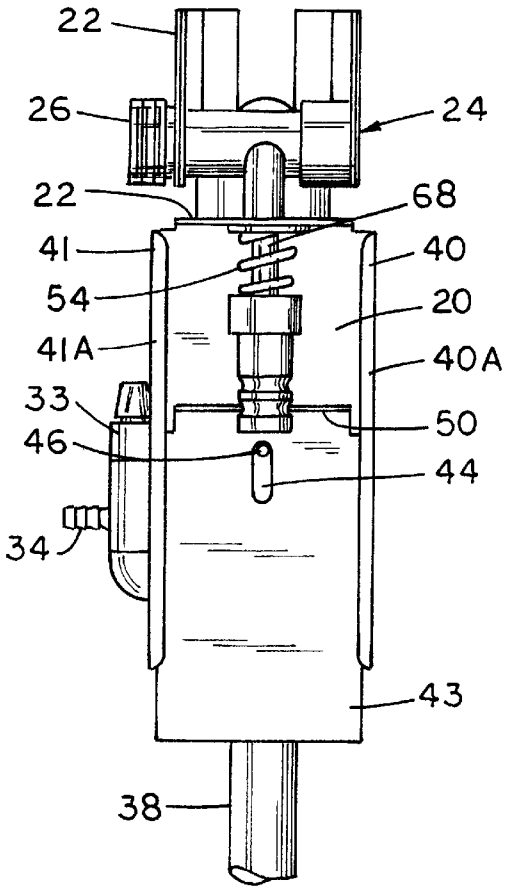
FIG. 4 is a view similar to FIG. 3 showing the front of the apparatus.
Figure 3:
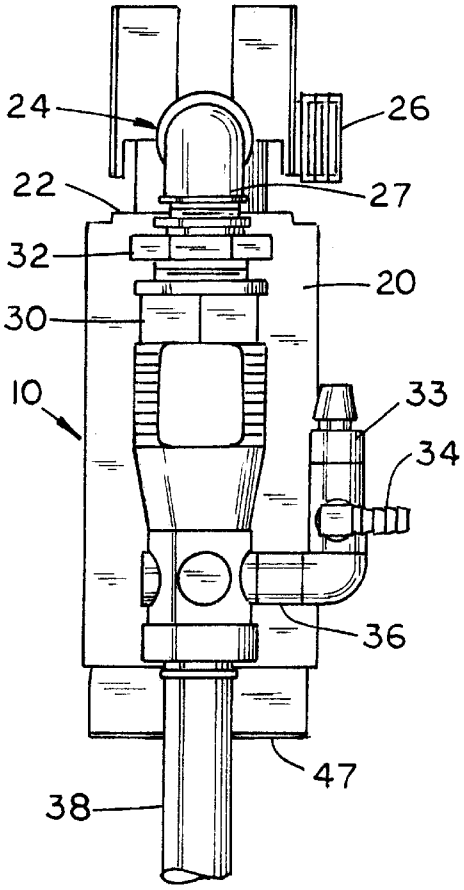
FIG. 3 is a back view of the apparatus shown in FIG. 1, without the housing.

As seen in FIGS. 2–4, the dispensing apparatus 10 includes a support member 20 with an upper portion 22 to which is connected a valve assembly 24 having a fluid intake portion 26 and an outlet portion 27. The valve assembly 24 is connected to the top panel 16 such as by screws 18. See FIG. 2. An eductor 30 is fastened to the outlet portion 27 by means of the nut connection 32. The preferred eductor 30 is available from S. C. Johnson Commercial Markets, Inc., Sturtevant, Wis.

A metering valve 33 is connected to eductor 30 by means of conduit 36. The preferred metering valve is disclosed in a commonly owned patent application entitled Precision Variable Rate Dispensing Valve, Ser. No.10/065,308, filed Oct. 2, 2002, the teachings of which are incorporated herein by reference. While this metering valve is preferred, any valve which can meter chemical concentrate can be employed such as those disclosed in U.S. Pat. Nos. 824,527 and 938,601. The metering valve has a barbed portion 34 for connection to a conduit (not shown) which in turn is in fluid communication with a source of chemical concentrate (not shown) such as a cleaning or sanitizing chemical. When a source of water is attached to valve intake portion 26, the flow of water through the eductor 30 causes a siphoning of concentrate into the diluting water stream with the combined stream exiting through outlet 38.

Support member 20 has lateral flanges 40 and 41 with lips 40*a* and 40*b* for slideably retaining slideable member 43 having lateral flanges such as 45 retained by the lips 40*a* and 41*a*. The extent of travel of the slideable member 43 is governed by the slot 44 and protrusion 46. At one end of the slideable member 43 is a U-shaped bottle contact member, which straddles outlet hose 38. Extending from slideable member 43 is a bracket 50 to which is connected a magnet holder 52 for magnet 51.

Figure 11:
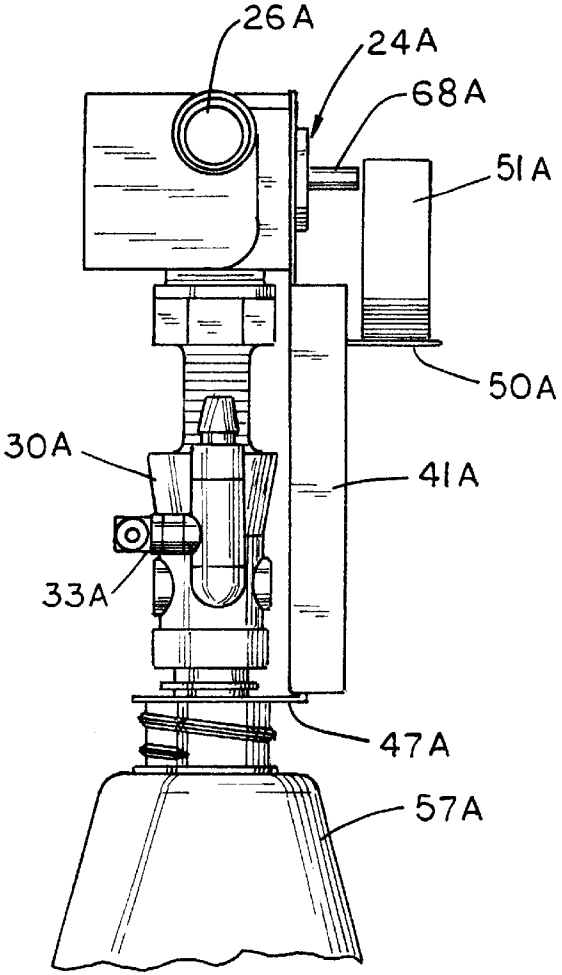
FIGS. 8–11 are views similar to FIGS. 3–6 of the alternative embodiment.
Figure 12:
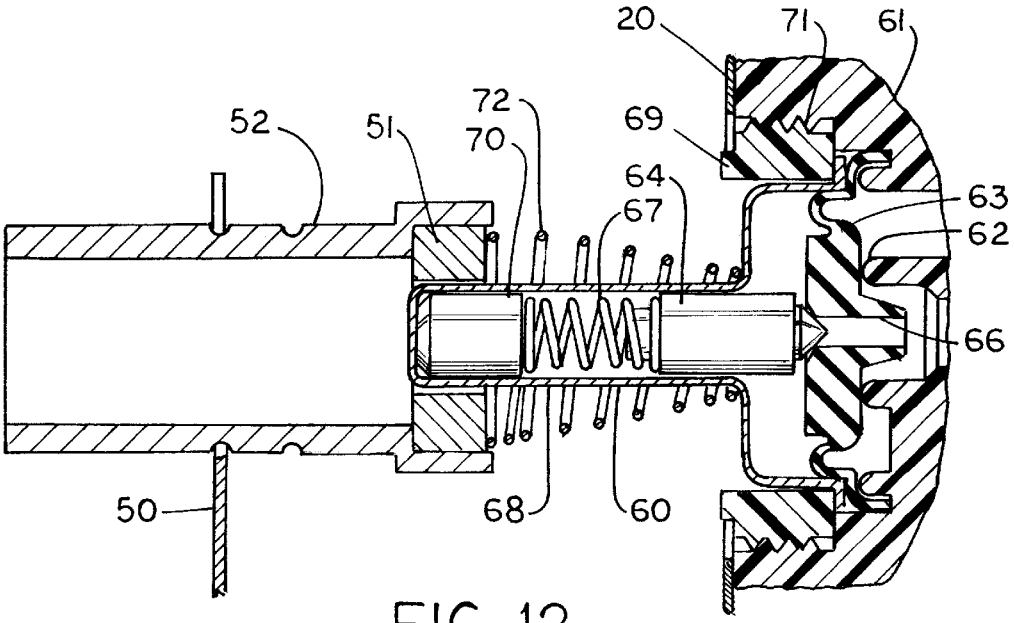
FIGS. 12 and 13 are cross-sectional views of a preferred valve for use with the dispensing apparatus.
Figure 13:
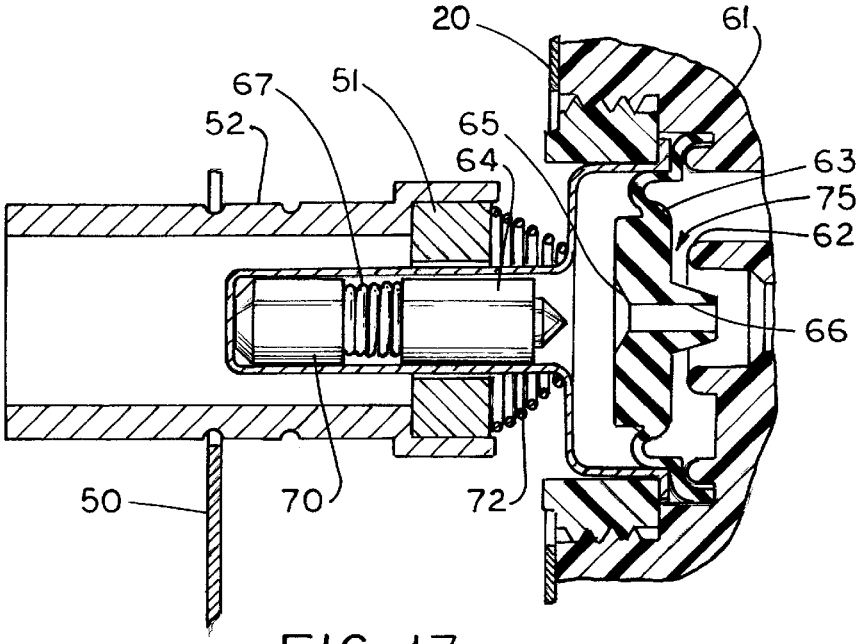

FIGS. 12 and 13 depict a valve member 60 which is housed in valve assembly 24. This valve is of the magnetic actuated type and is available from Dema Engineering Company in St. Louis, Mo. It operates in conjunction with the valve seat 62 which is part of the valve body 61. It includes a diaphragm 63 having a pocket 65 with an orifice 66. As seen in FIG. 11, a plunger 64 is constructed to seat in the pocket 65 in one position. A spring 67 biases the plunger 64 toward the diaphragm 63 and in a closed position of the valve. Plunger housing 68 accommodates the plunger 64, the spring 67 and the insert 70. A second spring 72 extends over the plunger housing 68 and biases the magnet 51 against the magnet holder 52. Plunger housing 68 is attached to the valve body 61 by cap 69 and the threads 71. In order to allow flow of water through the valve body 61 and to the eductor 30, the magnet 51 is moved inwardly as shown in FIG. 12. This moves the magnet 51 in the direction of the plunger 64 to magnetically attract the metal plunger 64 drawing it away from diaphragm 63. This allows water pressure to unseat the diaphragm 63, thus allowing water to flow in the direction of directional arrow 75.

Figure 5:
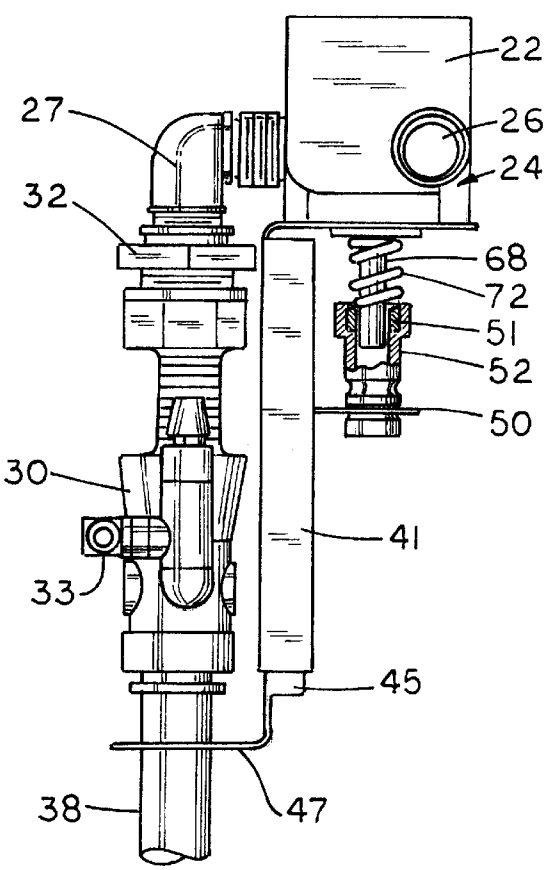
FIG. 5 is a view similar to FIG. 3 showing the side of the apparatus.
Figure 6:
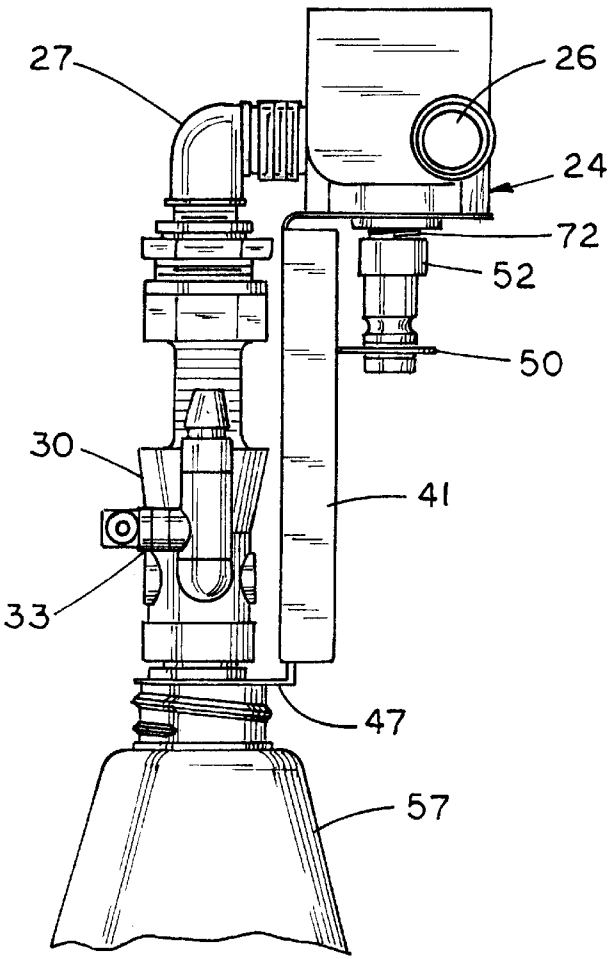
FIG. 6 is a view similar to FIG. 5 showing the apparatus in a valve activating position.
Figure 7:
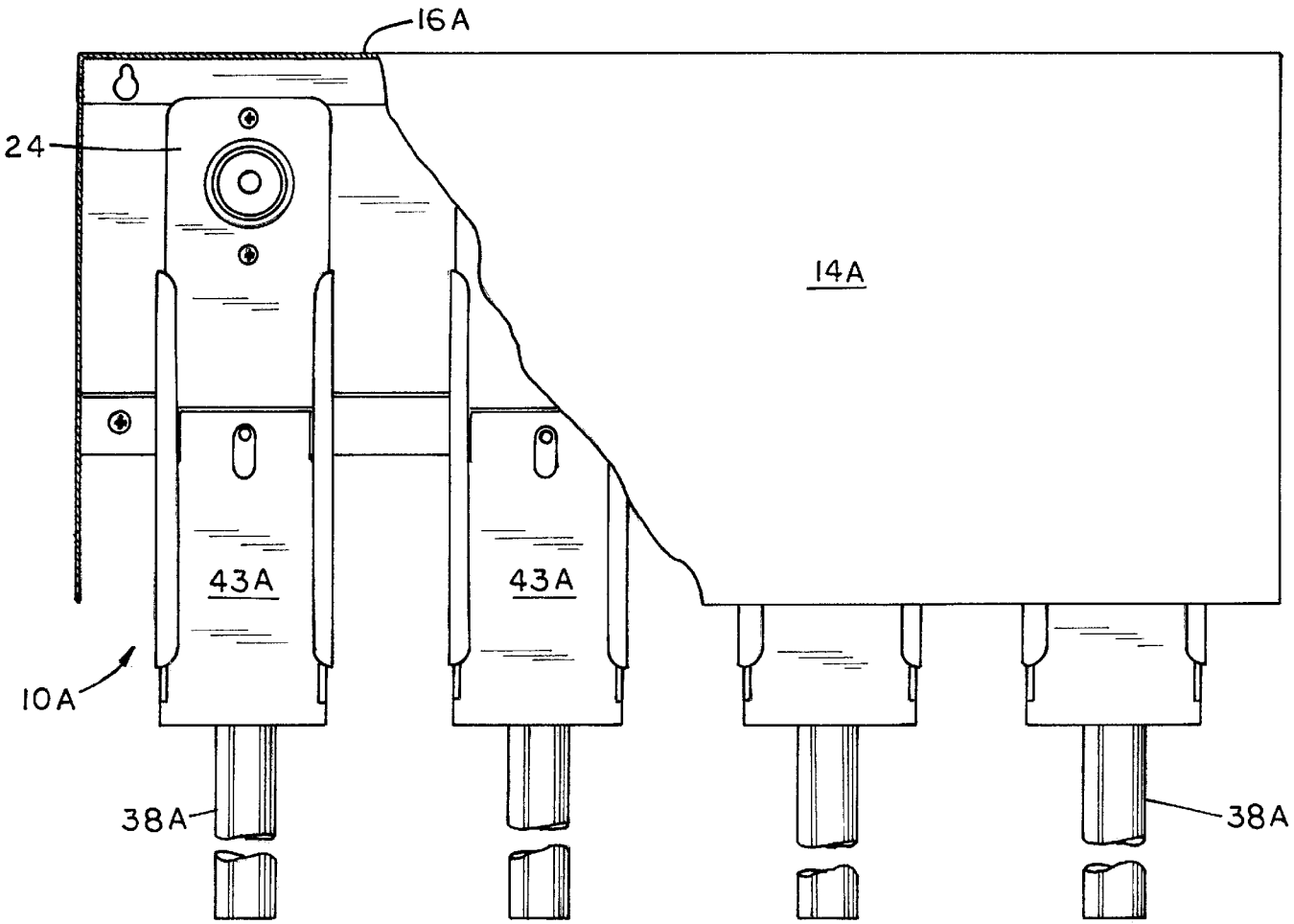
FIG. 7 is a perspective view of an alternative embodiment of the apparatus.
Figure 10:
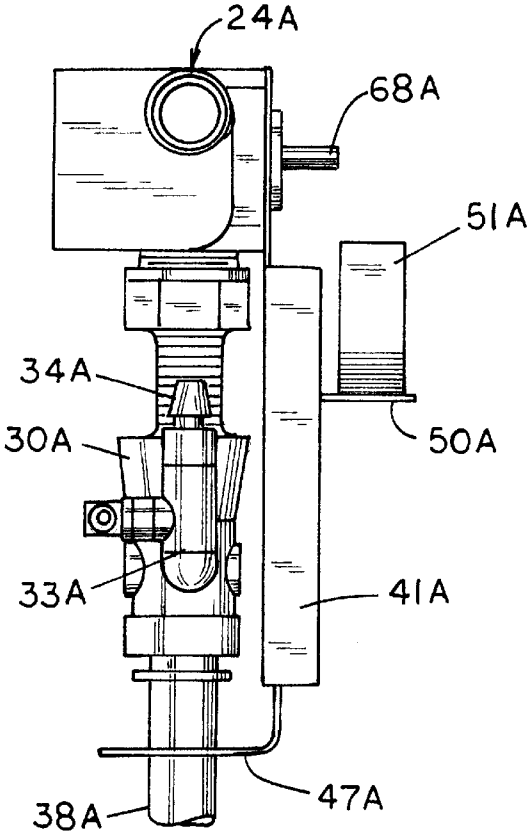
Figure 9:
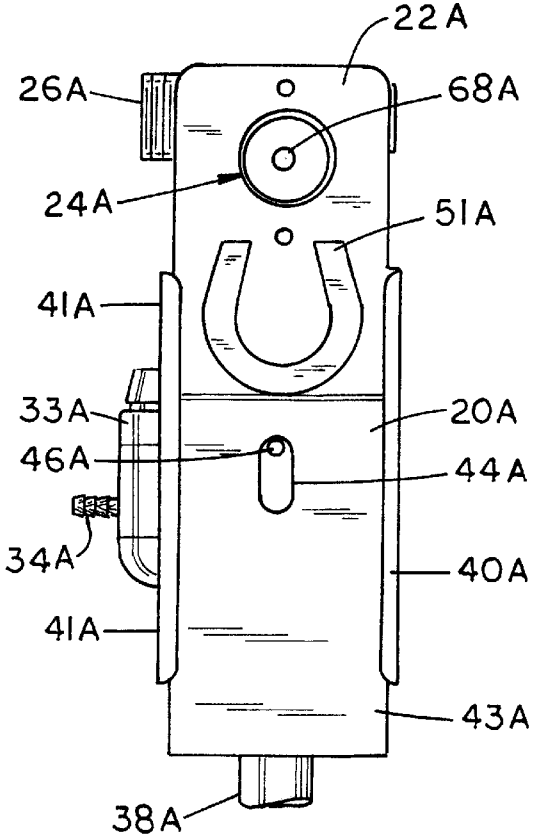
Figure 8:
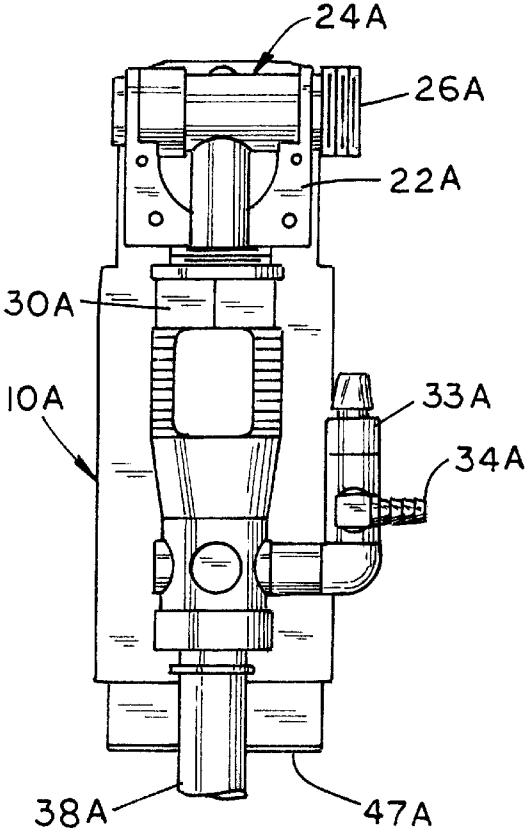

Referring to FIGS. 5 and 12, valve assembly 24 with valve member 60 is in a closed position. This is the result of magnet 51 being a sufficient distance from plunger 64 so that no magnetic force is exerted on plunger 64. Accordingly valve member 60 remains in a closed position. In order for valve member 60 to open, magnet 51 is moved in the direction of plunger 64. This exerts a magnetic force on it and opens the valve member as seen in FIG. 13. Movement of the magnet 51 in the direction of plunger 64 is caused by an upward movement of slideable member 43 when bottle contact member 47 is contacted by a bottle 57 and the bottle 57 moved upwardly. This is seen in FIG. 6. The opening of the valve member 60 results in water flowing through the valve 60 and into the eductor 30. This draws chemical concentrate into the water stream and a mixed solution through cutlet 38 and into the bottle 57.

FIGS. 7–11 depict an alternative embodiment generally 10A of the dispensing device. Similar components are designated by the same reference numerals except with an "A" suffix. In this embodiment 10A, the valve assembly is connected to a back panel 17A. The major difference between embodiment 10 and 10A is that embodiment 10A utilizes a horseshoe shaped magnet 51A to open valve member 60A which is the same as valve member 60 housed in valve assembly 24. As seen in FIG. 11, magnet 51 A is positioned in a transverse manner with respect to the valve member 60A and its housing 68A rather than in a parallel manner as with respect to embodiment 10, and seen in FIGS. 5 and 6. The advantage of embodiment 10A with respect to 10 is that the horseshoe shaped magnet 51A can approach the valve member 60A and its plunger 64 at an angle.

Operation of embodiment 10A with respect to opening valve member 60 is the same as with embodiment 10. Bottle 57A when moved upwardly will move slideable member 43A with bracket 50A and magnet 51A upwardly to open valve member 60A in the manner explained with respect to embodiment 10.

An important feature of this invention is the aspect that valve members 60 and 60A can be activated without any mechanical contact. As indicated earlier, a prior art one hand procedure for filling a bottle requires a frictional engagement between a slide actuator and a button for moving the magnet to attract the plungers 64 and 64A to open the valve members 60 and 60A. The elimination of the mechanical contact results in less wear and tear of component parts.

The dispensing devices 10 and 10A have been described as single units. It will be appreciated that a multiplicity of the devices can be employed in a single housing to dispense different chemical concentrates and solutions as seen in FIG. 1. While spring 72 is shown in conjunction with embodiment 10 and magnet holder 52, it can be eliminated as force of gravity will return the holder to its nonoperating position. All such and other modifications within the spirit of the invention are meant to be within its scope as defined by the appended claims.

What is claimed is:

1. A liquid mixing and dispensing apparatus comprising:

an eductor member having a liquid inlet, an inlet for liquid concentrate and an outlet for a mixed solution;

a valve member operatively connected to the liquid inlet of the eductor, the valve member including a magnetically operable moveable element for controlling the flow of liquid to the liquid inlet of the eductor;

a magnetic activating member operatively associated with the moveable element;

a magnet support member connected to the magnetic activating member, a magnet connected to the magnet support member, the magnetic activating member moving in a direction of the magnetic moveable element to open and close the valve member, the magnetic activating member including a bottle contact portion positioned proximate the eductor outlet; and the magnetic activating member including a slideable member, the slideable member including a support member connected to the valve member, the slideable member slideably engaging the support member.

2. The apparatus as defined in claim 1 wherein the slideable member is constructed in essentially one plane.

3. The apparatus as defined in claim 2 wherein the slideable member is positioned between the eductor and the valve member.

4. The apparatus as defined in claim 3 wherein the magnet support includes a bracket for connection with the magnet.

5. The apparatus as defined in claim 1 wherein the magnet is of an annular configuration and surrounds a valve stem of the valve member.

6. A liquid mixing and dispensing apparatus comprising:

an eductor member having a liquid inlet, an inlet for liquid concentrate and an outlet for a mixed solution;

a valve member operatively connected to the liquid inlet of the eductor, the valve member including a magnetically operable moveable element for controlling the flow of liquid to the liquid inlet of the eductor;

a magnetic activating member operatively associated with the moveable element; and a magnet support member connected to the magnetic activating member, a magnet connected to the magnet support member, the magnetic activating member moving in a direction of the magnetic moveable element to open and close the valve member, the magnetic activating member including a bottle contact portion positioned proximate the eductor outlet, the magnet being of a horse shoe configuration.

7. A liquid mixing and dispensing apparatus comprising:

an eductor member having a liquid inlet, an inlet for liquid concentrate and an outlet for a mixed solution;

a valve member operatively connected to the liquid inlet of the eductor, the valve member including a magnetically operable moveable element for controlling the flow of liquid to the liquid inlet of the eductor, the moveable element moving in a first direction;

a magnetic activating member operatively associated with the moveable element; and a magnet support member connected to the magnetic activating member, a magnet connected to the magnet support member, the magnetic activating member moving in a direction essentially perpendicular to the first direction to open and close the valve member, the magnetic activating member including a bottle contact portion positioned proximate the eductor outlet.

8. A method of mixing and dispensing a liquid solution from a dispensing apparatus having an eductor member with a liquid inlet, an inlet for liquid concentrate and an outlet for a mixed solution;

a valve member operatively connected to the liquid inlet of the eductor, the valve member including a magnetically operable moveable element for controlling the flow of liquid to the liquid inlet of the eductor, the magnetic moveable element moving in a first direction;

a magnetic activating member operatively associated with the magnetic moveable element; and a magnet support member connected to the magnetic activating member, a magnet connected to the magnet support member, the magnetic activating member moving in a direction of the moveable element and the magnetic activating member including a bottle contact portion positioned proximate the eductor outlet; comprising:

contacting a bottle with the bottle contact portion and with the bottle in fluid communication with the eductor outlet; and moving the bottle in a direction of the moveable element;

wherein the magnetically operable moveable element moves in a first direction and the bottle contact portion and bottle are moved in a direction essentially perpendicular to the moveable element.

9. The method of mixing and dispensing as defined in claim 8 wherein the magnetically operable moveable element moves in a first direction and the bottle contact portion and bottle are moved in a direction essentially parallel to the moveable element.

* * * * *